US010221803B2

(12) United States Patent
Ikemoto

(10) Patent No.: US 10,221,803 B2
(45) Date of Patent: Mar. 5, 2019

(54) FUEL INJECTION APPARATUS FOR INTERNAL COMBUSTION ENGINE

(71) Applicant: TOYOTA JIDOSHA KABUSHIKI KAISHA, Toyota-shi, Aichi-ken (JP)

(72) Inventor: Masato Ikemoto, Susono (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 92 days.

(21) Appl. No.: 15/083,339

(22) Filed: Mar. 29, 2016

(65) Prior Publication Data

US 2016/0290271 A1 Oct. 6, 2016

(30) Foreign Application Priority Data

Mar. 30, 2015 (JP) ..... 2015-068969
Jan. 15, 2016 (JP) ..... 2016-006225

(51) Int. Cl.

| | |
|---|---|
| ***F02D 41/00*** | (2006.01) |
| ***F02D 41/38*** | (2006.01) |
| ***F02M 47/02*** | (2006.01) |
| ***F02M 57/02*** | (2006.01) |
| *F02M 63/00* | (2006.01) |
| *F02M 63/02* | (2006.01) |

(52) U.S. Cl.

CPC ..... *F02D 41/3836* (2013.01); *F02M 47/027* (2013.01); *F02M 57/025* (2013.01); *F02D 41/3872* (2013.01); *F02D 2200/0602* (2013.01); *F02M 63/0045* (2013.01); *F02M 63/0225* (2013.01)

(58) Field of Classification Search

CPC . F02M 47/027; F02M 57/025; F02D 41/3836
See application file for complete search history.

(56) References Cited

U.S. PATENT DOCUMENTS 6,962,141 B2 * 11/2005 Kern ..... F02M 45/02 123/446
7,165,527 B2 * 1/2007 Okude ..... F02D 35/025 123/299
7,320,311 B2 * 1/2008 Futonagane ..... F02D 41/3836 123/446
7,461,634 B2 * 12/2008 Watanabe ..... F02D 41/221 123/446

(Continued)

FOREIGN PATENT DOCUMENTS

JP 2004-44494 2/2004
JP 2005-315195 A 11/2005

(Continued)

*Primary Examiner* — Hieu T Vo
*Assistant Examiner* — Sherman Manley
(74) *Attorney, Agent, or Firm* — Finnegan, Henderson, Farabow, Garrett & Dunner, LLP

(57) ABSTRACT

The pressure of the fuel is increased at a constant pressure intensification ratio after operating the pressure reducing device so that the pressure difference between the fuel passage and the control chamber after the operation has a value smaller than the predetermined pressure difference, if the required pressure of the fuel is higher than a reference pressure and lower than a pressure obtained by multiplying the reference pressure by a constant pressure intensification ratio.

4 Claims, 5 Drawing Sheets

(56) References Cited

U.S. PATENT DOCUMENTS

| | | | | |
|---|---|---|---|---|
| 7,865,293 | B2 * | 1/2011 | Ishizuka | F02D 41/40 123/486 |
| 8,100,345 | B2 * | 1/2012 | Hotta | F02M 41/124 239/533.2 |
| 8,443,780 | B2 * | 5/2013 | Coldren | F02M 63/0045 123/299 |
| 2003/0150426 | A1 * | 8/2003 | Tanabe | F02D 41/3836 123/457 |
| 2003/0183198 | A1 * | 10/2003 | Mahr | F02M 47/027 123/447 |
| 2003/0213470 | A1 * | 11/2003 | Kohketsu | F02D 41/3836 123/447 |
| 2004/0194756 | A1 * | 10/2004 | Hotta | F02D 41/3836 123/299 |
| 2004/0194762 | A1 * | 10/2004 | Okamoto | F02D 41/3872 123/458 |
| 2006/0144367 | A1 | 7/2006 | Futonagane et al. | |

FOREIGN PATENT DOCUMENTS

| | | |
|---|---|---|
| JP | 2009-30490 | 2/2009 |
| JP | 2010-71222 | 4/2010 |
| JP | 2013-256916 | 12/2013 |

* cited by examiner

[Fig. 1]
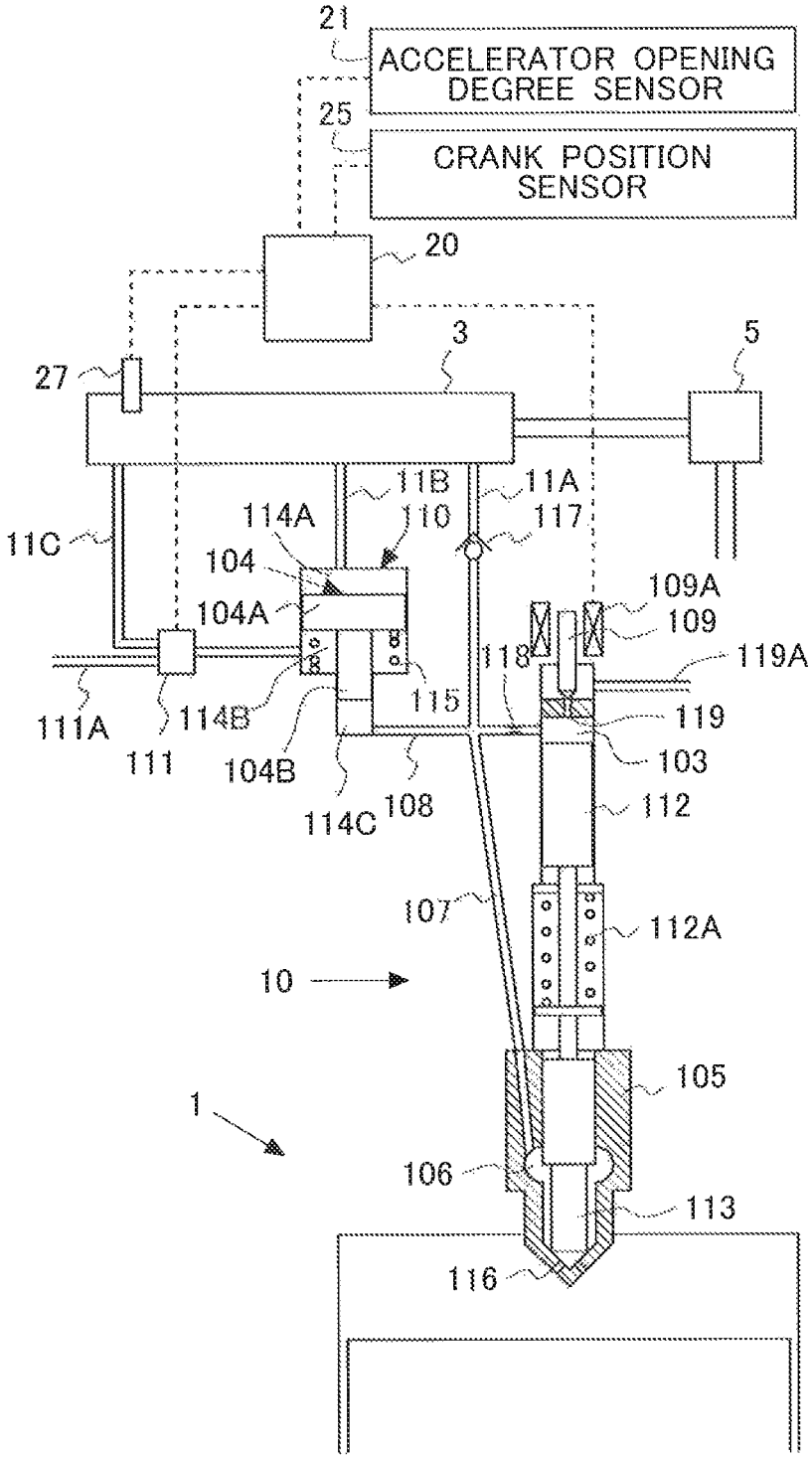

[Fig. 2]
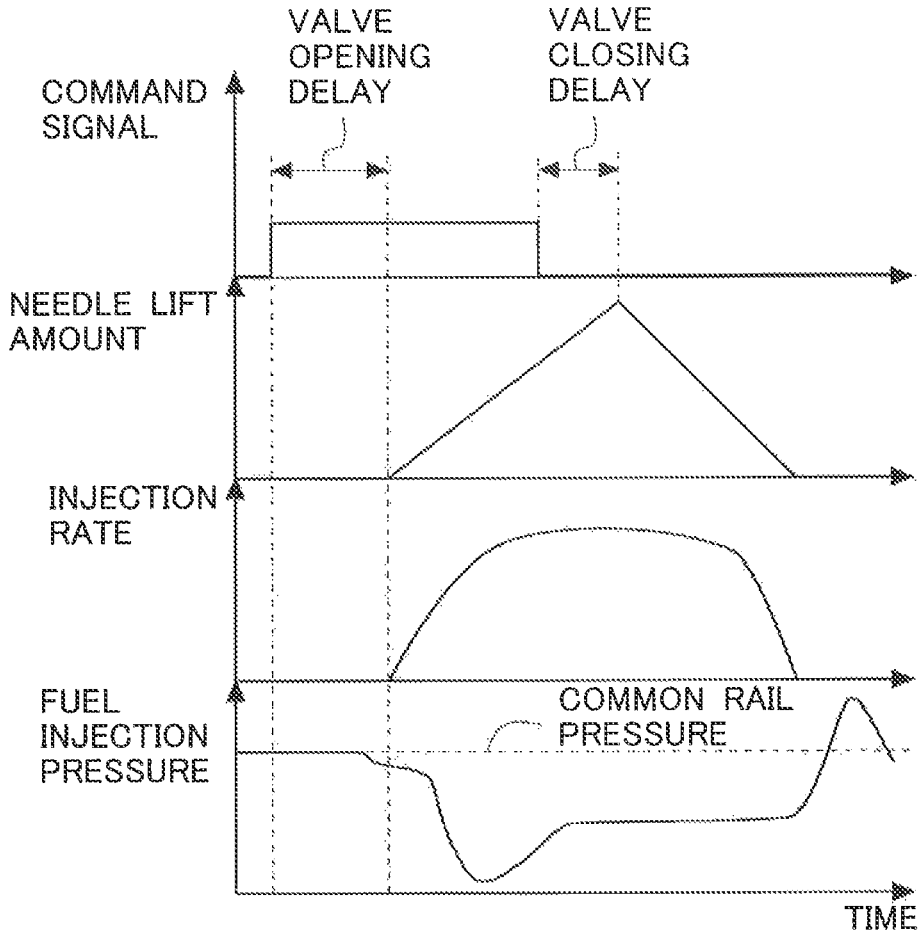

[Fig. 3]
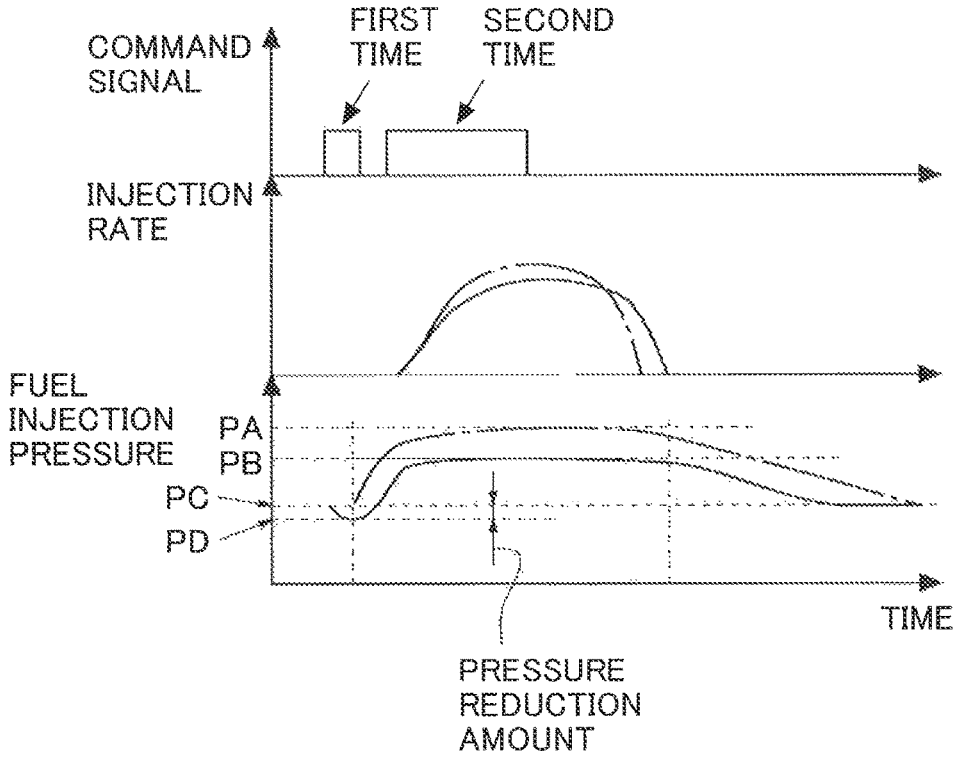

[Fig. 4]
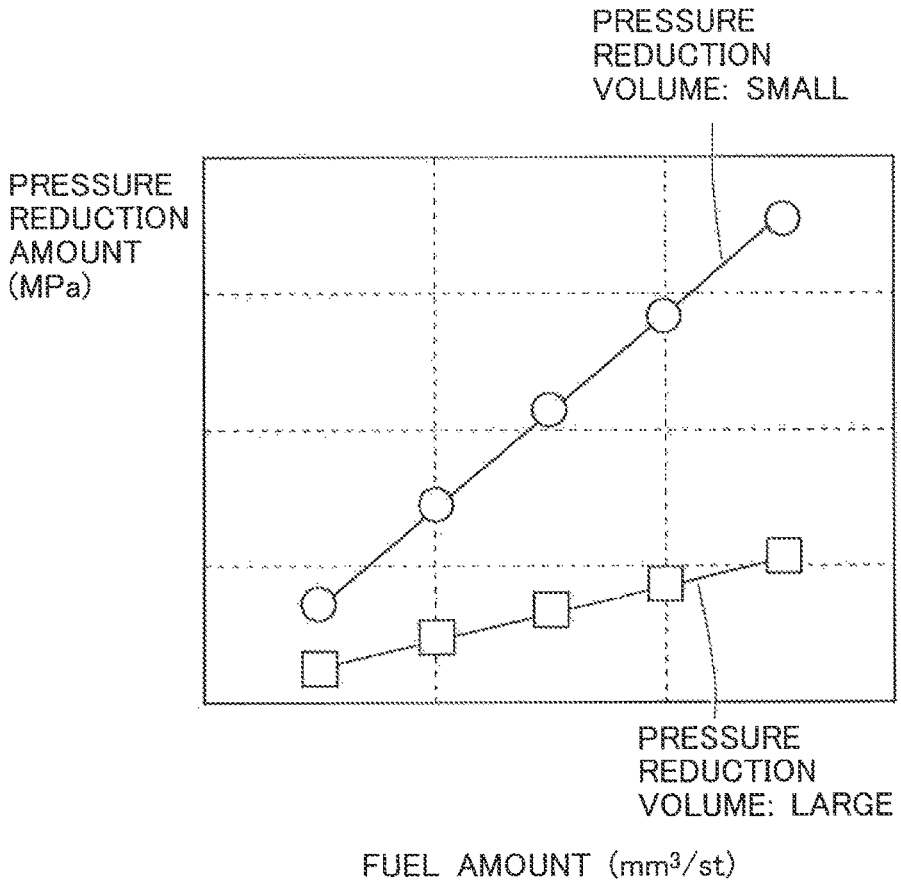

[Fig. 5]
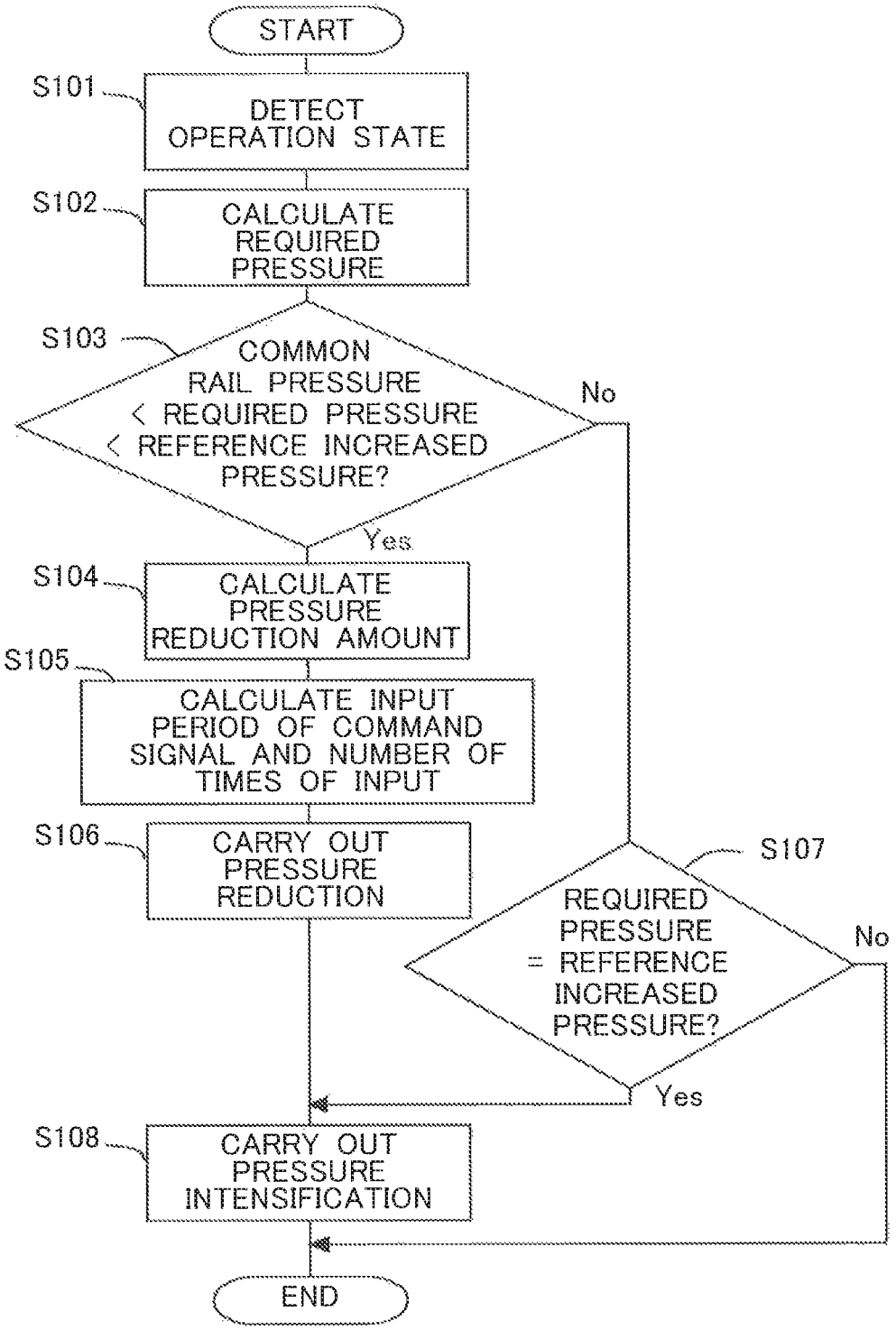

FUEL INJECTION APPARATUS FOR INTERNAL COMBUSTION ENGINE

CROSS REFERENCE TO RELATED APPLICATIONS

This application claims priority to Japanese Patent Application No. 2015-068969 filed on Mar. 30, 2015, and Japanese Patent Application No. 2016-006225 filed on Jan. 15, 2016, the entire contents of which are incorporated by reference herein.

TECHNICAL FIELD

The present invention relates to a fuel injection apparatus for an internal combustion engine.

BACKGROUND ART

A fuel injection valve is known, which is provided with a pressure intensifying device (pressure increasing device) for increasing the fuel injection pressure at a constant pressure intensification ratio. In the case of such a fuel injection valve, the fuel injection pressure can be set to any one of the pressures of the reference pressure and the pressure (hereinafter referred to as "reference increased pressure" as well) obtained by multiplying the reference pressure by the pressure intensification ratio. In this context, it is known that the fuel injection pressure, which is provided upon the start of the fuel injection, is set to a pressure between the reference pressure and the reference increased pressure, by starting the fuel injection during the pressure intensification (see, for example, Patent Literature 1).

PRIOR ART LITERATURES

Patent Literatures

Patent Literature 1: Japanese Patent Application Laid-Open No. 2004-044494

Patent Literature 2: Japanese Patent Application Laid-Open No. 2010-071222

Patent Literature 3: Japanese Patent Application Laid-Open No. 2009-030490

Patent Literature 4: Japanese Patent Application Laid-Open No. 2013-256916

SUMMARY OF THE INVENTION

Problems to be Solved by the Invention

In the case of the conventional technique, the fuel injection pressure, which is provided upon the start of the fuel injection, can be adjusted. However, the pressure intensification (pressure increase) of the fuel also continues after the start of the fuel injection until the fuel injection pressure arrives at the reference increased pressure. Therefore, the fuel injection pressure is consequently changed during the fuel injection. On this account, the fuel injection pressure during the fuel injection was unable to be maintained at any arbitrary pressure between the reference pressure and the reference increased pressure. Further, if the fuel injection pressure cannot be adjusted to a proper value, it is feared that the combustion noise or the smoke may be produced. On the other hand, if the fuel injection pressure before the fuel injection is maintained at a predetermined value, it is possible to suppress the fluctuation of the fuel injection pressure during the fuel injection.

The present invention has been made taking the foregoing problem into consideration, an object of which is to maintain the fuel injection pressure at any arbitrary pressure between the reference pressure and the reference increased pressure.

Means for Solving the Problems

In order to solve the problem as described above, according to the present invention, there is provided a fuel injection apparatus for an internal combustion engine, comprising a fuel injection valve configured to inject fuel by opening an injection hole in accordance with movement of a needle; a high pressure fuel retaining unit configured to supply the fuel at a reference pressure to the fuel injection valve; a fuel passage which is communicated with the injection hole from the high pressure fuel retaining unit; an opening/closing device which includes a control chamber connected to the fuel passage and a pressure reducing device for lowering a pressure of the fuel contained in the control chamber as compared with a pressure of the fuel contained in the fuel passage and which moves the needle in a direction to open the injection hole if a pressure difference between the pressure of the fuel contained in the fuel passage and the pressure of the fuel contained in the control chamber is not less than a predetermined pressure difference; a pressure intensifying device which is connected to the fuel passage and configured to increase the pressure of the fuel contained in the fuel passage at a constant pressure intensification ratio; and a controller comprising at least one processor configured to increase the pressure of the fuel contained in the fuel passage by means of the pressure intensifying device after operating the pressure reducing device so that the pressure difference after the operation has a value smaller than the predetermined pressure difference, if the pressure of the fuel contained in the fuel passage, which is required upon fuel injection from the fuel injection valve, is higher than the reference pressure and lower than a reference increased pressure as a value obtained by multiplying the reference pressure by the pressure intensification ratio.

In the state in which the pressure reducing device is not operated, the pressure in the control chamber is equal to the pressure of the fuel contained in the fuel passage. In this state, the injection hole is closed by the needle. In this situation, the force, which is directed in the direction to close the valve, is larger than the force which is applied to the needle and which is directed in the direction to open the valve. When the pressure reducing device is operated, then the pressure of the control chamber becomes lower than the pressure of the fuel passage, and thus the force, which is applied to the needle and which is directed in the direction to close the valve, is lowered. Then, when the force, which is directed in the direction to open the valve, is larger than the force which is applied to the needle and which is directed in the direction to close the valve, then the needle is moved and the injection hole is opened. Thus, the fuel is injected. In this case, when the pressure reducing device is operated, the pressure of the fuel contained in the control chamber is lowered in order to lower the force which is applied to the needle and which is directed in the direction to close the valve. The decrease in the pressure of the fuel contained in the control chamber may occur even before the fuel is actually injected from the fuel injection valve. Then, the control chamber is communicated with the fuel passage. Therefore, the decrease in the pressure of the fuel contained in the control chamber also lowers the pressure of the fuel contained in the fuel passage thereafter. On this account, the pressure difference of the fuel is immediately dissolved, although the pressure difference temporarily occurs. In this way, the pressure of the fuel contained in the fuel passage is also lowered so that the pressure difference of the fuel is dissolved after the pressure of the fuel contained in the control chamber is lowered. Therefore, the fuel injection pressure is lowered. Therefore, the fuel injection pressure can be made lower than the reference pressure by operating the pressure reducing device within such a range that the fuel is not injected from the fuel injection valve. Note that the predetermined pressure difference is also referred to as the pressure difference at which the fuel injection begins. Then, the pressure intensifying device increases the fuel injection pressure at the constant pressure intensification ratio. Therefore, the fuel injection pressure, which is provided after being lowered as compared with the reference pressure, can be increased at the constant pressure intensification ratio. Therefore, the fuel injection pressure after the pressure intensification, which is provided when the pressure reducing device is operated before the pressure intensification, is lower than that provided when the pressure reducing device is not operated before the pressure intensification. That is, the fuel injection pressure can be maintained at any arbitrary pressure which is higher than the reference pressure and which is lower than the reference increased pressure. Then, the fuel injection can be started in such a state that the pressure intensification has been completed before the start of the fuel injection. Therefore, it is possible to suppress such a situation that the pressure intensification is performed during the fuel injection and the fuel injection pressure is fluctuated. In this way, the fuel injection pressure can be adjusted to the proper value. Therefore, it is possible to suppress the combustion noise, or it is possible to reduce the amount of production of the smoke.

Further, the controller can change a number of times of the operation of the pressure reducing device depending on the pressure of the fuel contained in the fuel passage required during the fuel injection, when the pressure reducing device is operated so that the pressure difference after the operation has a value smaller than the predetermined pressure difference.

When the pressure reducing device is operated within the range in which the fuel is not injected from the fuel injection valve, it is necessary to stop the pressure reducing device before the fuel is injected. Therefore, the amount of decrease in the fuel injection pressure per one time, which is provided when the pressure reducing device is operated within the range in which the fuel is not injected from the fuel injection valve, is also restricted. On the other hand, if the fuel pressure difference is dissolved after the occurrence of the fuel pressure difference caused by operating the pressure reducing device within the range in which the fuel is not injected from the fuel injection valve, the pressure reducing device can be further operated. The fuel injection pressure is lower than the reference pressure immediately after the dissolution of the fuel pressure difference. Therefore, when the pressure reducing device is operated again in this situation, it is thereby possible to further lower the fuel injection pressure. In this way, the amount of decrease in the fuel injection pressure can be further increased without injecting the fuel by repeatedly operating the pressure reducing device a plurality of times. Therefore, the fuel injection pressure after the pressure intensification can be adjusted in a wider range.

Further, the controller can change a period in which the pressure reducing device is operated, depending on the pressure of the fuel contained in the fuel passage required during the fuel injection, when the pressure reducing device is operated so that the pressure difference after the operation has a value smaller than the predetermined pressure difference.

The amount of decrease in the fuel injection pressure changes depending on the length of the period in which the pressure reducing device is operated within the range in which the fuel is not injected from the fuel injection valve. Therefore, the amount of decrease in the fuel injection pressure can be adjusted by adjusting the length of the period in which the pressure reducing device is operated within the range in which the fuel is not injected from the fuel injection valve. In this case, the longer the period in which the pressure reducing device is operated is, the larger the amount of decrease in the pressure in the control chamber is. Therefore, the amount of decrease in the fuel injection pressure is increased as well. In this way, the amount of decrease in the fuel injection pressure can be adjusted, and hence the fuel injection pressure after the pressure intensification can be also adjusted. Further, the fuel injection pressure can be adjusted to any arbitrary pressure ranging from the reference pressure to the reference increased pressure by increasing the fuel injection pressure after lowering the fuel injection pressure by adjusting the number of times of the operation of the pressure reducing device and the period of the operation of the pressure reducing device.

Advantageous Effect of the Invention

According to the present invention, the fuel injection pressure can be maintained at any arbitrary pressure between the reference pressure and the reference increased pressure.

BRIEF DESCRIPTION OF THE DRAWINGS

FIG. 1 illustrates a schematic arrangement of a fuel injection valve having a pressure intensifying unit.

FIG. 2 shows a time chart illustrating the transition of various values when the fuel is injected from the fuel injection valve.

FIG. 3 shows a time chart illustrating the transition of the command signal, the injection rate, and the fuel injection pressure when the pressure reduction is carried out before the pressure intensification of the fuel.

FIG. 4 shows the relationship among the amount of the fuel flowing through a drain piping, the pressure reduction amount, and the pressure reduction volume.

FIG. 5 shows a flow chart illustrating a flow for adjusting the fuel injection pressure according to a first embodiment.

EMBODIMENTS FOR CARRYING OUT THE INVENTION

An explanation will be made in detail below by way of example with reference to the drawings on the basis of an embodiment about a mode for carrying out the present invention. However, for example, the dimension or size, the material, the shape, and the relative arrangement of each of constitutive parts or components described in the embodiment are not intended to limit the scope of the present invention only thereto unless specifically noted.

Embodiment

An embodiment of the present invention will be explained below by using the drawings. FIG. 1 illustrates a schematic arrangement of a fuel injection valve 10 having a pressure intensifying unit 110. The fuel injection valve 10 according to this embodiment is used, for example, for an internal combustion engine 1 carried on a vehicle. The internal combustion engine 1 according to this embodiment is a diesel engine. However, the present invention is also usable for any gasoline engine. When the internal combustion engine 1 has a plurality of cylinders, the fuel injection valve 10 is provided for each of the cylinders.

The internal combustion engine 1 is provided with a common rail 3 for retaining the high pressure fuel. The common rail 3 is connected to a high pressure fuel pump 5. The common rail 3 retains the fuel having the pressure raised by the high pressure fuel pump 5. Further, the common rail 3 is connected with a first fuel piping 11A, a second fuel piping 11B, and a third fuel piping 11C communicated with the fuel injection valve 10. Note that in FIG. 1, the pipings are shown while being classified into the first fuel piping 11A, the second fuel piping 11B, and the third fuel piping 11C. However, in place thereof, one high pressure piping may be connected to the common rail 3, and the one high pressure piping may be branched into three. Note that in this embodiment, the common rail 3 corresponds to the high pressure fuel retaining unit according to the present invention.

The high pressure fuel pump 5 according to this embodiment is, for example, a pump of the plunger type having a discharge amount regulating mechanism. The pressure of the fuel supplied from an unillustrated fuel tank is raised to a predetermined pressure, and the fuel is supplied to the common rail 3. The feeding amount of the fuel fed under the pressure from the high pressure fuel pump 5 to the common rail 3 is subjected to the feedback control by ECU 20 as described later on so that the common rail pressure becomes a target pressure.

The internal combustion engine 1 is provided in combination with ECU 20 which is an electronic control unit for controlling the internal combustion engine 1. ECU 20 is constructed as a digital computer having a known structure including a read only memory (ROM), a random access memory (RAM), a microprocessor (CPU), and an input/output port connected by a bidirectional bus. ECU 20 controls the fuel injection timing and the fuel injection amount from the fuel injection valve 10, and ECU 20 controls, other than the above, for example, the engine rotation speed. Therefore, ECU 20 is also referred to as the electronic control unit for controlling the fuel injection valve 10.

The common rail 3 is provided with a fuel pressure sensor 27 which detects the pressure of the fuel contained in the common rail 3 (hereinafter referred to as "common rail pressure"). The fuel pressure sensor 27 is connected to ECU 20 via an electrical wiring. Further, ECU 20 is connected via electrical wirings with an accelerator opening degree sensor 21 which outputs an electric signal corresponding to the pedaling amount of an accelerator pedal pedaled by a driver to detect the engine load, and a crank position sensor 25 which detects the engine rotation speed. Then, the output signals of the various sensors are inputted into ECU 20. Note that in this embodiment, the common rail pressure corresponds to the reference pressure according to the present invention.

ECU 20 calculates the engine rotation speed from the frequency of the crank rotation angle pulse signal inputted from the crank position sensor 25. ECU 20 calculates the fuel injection timing and the fuel injection amount of the fuel injection valve 10 on the basis of the engine rotation speed and the accelerator opening degree signal inputted from the accelerator opening degree sensor 21.

The fuel injection valve 10 is provided with the pressure intensifying unit 110. Further, the fuel injection valve 10 is provided with a nozzle 105 which is formed with an injection hole 116. Further, the fuel injection valve 10 is provided with a needle 113 which opens/closes the injection hole 116. A fuel pool 106 is formed around the needle 113 in the nozzle 105. Further, the fuel injection valve 10 is provided with a command piston 112 which receives the pressure of the fuel contained in a control chamber 103 described later on to push the needle 113 in the downward direction as viewed in FIG. 1 (direction in which the needle 113 is directed toward the injection hole 116), and a spring 112A which pushes the needle in the direction to open the valve independently from the command piston 112.

The control chamber 103 is formed adjacently to the command piston 112 in the upward direction as viewed in FIG. 1 (direction in which the needle 113 is separated from the injection hole 116). The control chamber 103 is provided with an injection control valve 109 having a solenoid actuator 109A. The solenoid actuator 109A is controlled by ECU 20. The fuel contained in the control chamber 103 flows to a drain piping 119A via an orifice 119 by operating the solenoid actuator 109A. That is, the pressure in the control chamber 103 is lowered by operating the solenoid actuator 109A. The control chamber 103 is connected via an orifice 118 to a pressure intensification passage 108, an injection passage 107, and the first fuel piping 11A. A check valve 117 is provided for the first fuel piping 11A. The check valve 117 allows the fuel to flow only from the side of the common rail 3 to the side of the fuel injection valve 10. Note that in this embodiment, the injection passage 107 corresponds to the fuel passage according to the present invention. Further, in this embodiment, the control chamber 103, the injection control valve 109, the orifice 118, and the orifice 119 correspond to the opening/closing device according to the present invention. Further, in this embodiment, the injection control valve 109 corresponds to the pressure reducing device according to the present invention.

The injection passage 107 is connected to the fuel pool 106 of the nozzle 105. When the fuel subjected to the pressure intensification is injected, then the fuel, which is subjected to the pressure intensification by the pressure intensifying unit 110, flows through the pressure intensification passage 108 and the injection passage 107, and the fuel is supplied to the fuel pool 106. The fuel injection pressure is the pressure of the fuel in the fuel pool 106. Therefore, the pressure of the fuel subjected to the pressure intensification by the pressure intensifying unit 110 is the fuel injection pressure. On the other hand, when fuel not subjected to the pressure intensification is injected, then the fuel, which comes from the common rail 3, flows through the first fuel piping 11A and the injection passage 107, and the fuel is supplied to the fuel pool 106. On this account, the common rail pressure is the fuel injection pressure.

In this case, the fuel pressure in the control chamber 103 is the fuel pressure which is applied in the direction to close the injection hole 116 with respect to the needle 113. The fuel pressure in the fuel pool 106 is the fuel pressure which is applied in the direction to open the injection hole 116 with respect to the needle 113. The control chamber 103 is communicated with the fuel pool 106 via the orifice 118. On this account, when the injection control valve 109 is closed, the fuel pressure in the control chamber 103 is approximately equal to the pressures of the injection passage 107 and the fuel pool 106. In this state, the needle 113 is pushed by a spring 112A, and the needle 113 is brought in tight contact with the seat disposed at the forward end of the nozzle to close the injection hole 116.

On the other hand, when the electricity is applied to the solenoid actuator 109A, and the injection control valve 109 is opened, then the fuel contained in the control chamber 103 passes through the orifice 119 to flow out to the drain piping 119A, and the pressure in the control chamber 103 is lowered. Accordingly, the pressure in the control chamber 103 becomes lower than the pressures of the injection passage 107 and the fuel pool 106. Therefore, the needle 113 is pushed by the pressure of the fuel contained in the fuel pool 106, and the needle 113 is moved in the direction to make separation from the injection hole 116 against the pushing force of the spring 112A. On this account, the injection hole 116 is opened, and the fuel contained in the fuel pool 106 is injected from the injection hole 116. The control chamber 103 is communicated with the fuel pool 106 via the orifice 118. Therefore, if a sufficient time elapses after the valve opening of the injection control valve 109, the fuel pressure in the control chamber 103 becomes equal to the fuel pressure in the fuel pool 106.

Next, the pressure intensifying unit 110 will be explained. The pressure intensifying unit 110 is provided with a pressure intensifying piston 104 which has a large diameter piston portion 104A and a small diameter piston portion 104B. A pressure intensification control chamber 114B is formed on the small diameter piston portion 104B side of the large diameter piston portion 104A, and a pressure chamber 114A, which is communicated with the common rail 3 via the second fuel piping 11B, is formed on the side of the large diameter piston portion 104A opposite to the pressure intensification control chamber 114B. Further, a pressure intensifying chamber 114C, which is communicated with the pressure intensification passage 108, is formed at the end portion of the small diameter piston portion 104B of the pressure intensifying piston 104.

The pressure intensifying unit 110 is provided with a pressure intensification control valve 111. Then, the pressure intensification control valve 111 is connected to the pressure intensification control chamber 114B. The pressure intensification control valve 111 is a changeover valve (selector valve) driven by a solenoid, which selectively connects the pressure intensification control chamber 114 to the third fuel piping 11C or the drain piping 111A. The pressure intensification control valve 111 (which may be regarded as the pressure intensifying unit 110) is controlled by ECU 20.

When the pressure intensifying unit 110 is not operated, the application of electricity to the solenoid actuator of the pressure intensification control valve 111 is stopped. The pressure intensification control chamber 114B is connected via the pressure intensification control valve 111 to the third fuel piping 11C. Therefore, the common rail pressure acts in the pressure intensification control chamber 114B. Further, the common rail pressure acts on the pressure chamber 114A of the pressure intensifying unit 110 via the second fuel piping 11B. Therefore, the pressures, which are provided on the both sides of the large diameter piston portion 104A of the pressure intensifying piston 104, are equal to one another.

In this state, the pressure intensifying piston 104 is moved to the upper position as viewed in FIG. 1 by being pushed by a spring 115 which urges the large diameter piston portion 104A toward the side of the pressure chamber 114A. The fuel flows into the pressure intensifying chamber 114C from the common rail 3 via the first fuel piping 11A and the check valve 117. On this account, the fuel pressures in the pressure intensification passage 108 and the injection passage 107 are equal to the common rail pressure. That is, when the pressure intensifying unit 110 is not operated, the pressure of the fuel injected from the fuel injection valve 10 is the common rail pressure.

On the other hand, when the electricity is applied to the solenoid of the pressure intensification control valve 111, the pressure intensification control chamber 114B is connected to the drain piping 111A via the pressure intensification control valve 111. Accordingly, the fuel contained in the pressure intensification control chamber 114B flows out from the pressure intensification control valve 111 to the drain piping 111A, and the pressure of the pressure intensification control chamber 114B is lowered. On this account, the pressure intensifying piston 104 is pushed by the pressure of the fuel contained in the pressure chamber 114A allowed to act on the large diameter piston portion 104A. The fuel contained in the pressure intensifying chamber 114C is pressurized by the small diameter piston portion 104B. Accordingly, the fuel pressure in the pressure intensifying chamber 114C is approximately equal to the value which is obtained by multiplying the common rail pressure in the pressure chamber 114A by the cross-sectional area ratio between the large diameter piston portion 104A and the small diameter piston portion 104B.

That is, when the pressure intensifying unit 110 is operated, the pressures in the pressure intensifying chamber 114C, the pressure intensification passage 108, the injection passage 107, the fuel pool 106, and the control chamber 103 are increased to the pressure which is obtained by the multiplication by the cross-sectional area ratio between the large diameter piston portion 104A and the small diameter piston portion 104B of the pressure intensifying piston 104. Therefore, if the pressures in the pressure intensifying chamber 114C, the pressure intensification passage 108, the injection passage 107, the fuel pool 106, and the control chamber 103 are the common rail pressure before the operation of the pressure intensifying unit 110, the fuel injection pressure is increased to the reference increased pressure when the pressure intensifying unit 110 is operated. Note that the cross-sectional area ratio described above is hereinafter referred to as "pressure intensification ratio". The pressure intensification ratio is a constant value defined by the shape of the pressure intensifying piston.

In this way, in the case of the fuel injection valve 10 provided with the pressure intensifying unit 110 of this embodiment, the fuel injection pressure can be increased from the low pressure (i.e., the common rail pressure) to the high pressure (i.e., the reference increased pressure) by switching the operation and the non-operation of the pressure intensifying unit 110. Note that in this embodiment, the pressure intensifying unit 110, which performs the pressure intensification at the constant pressure intensification ratio, corresponds to the pressure intensifying device according to the present invention.

In the case of any general fuel injection apparatus which adopts the pressure intensifying unit 110 having the structure as described above, the fuel injection pressure can be set to any one of the pressures of the common rail pressure and the reference increased pressure as the pressure obtained by multiplying the common rail pressure by the pressure intensification ratio. However, the optimum value of the fuel injection pressure changes depending on the operation state of the internal combustion engine 1. Therefore, there may be such a situation that the required value of the fuel injection pressure (i.e., the required pressure) is higher than the common rail pressure and lower than the reference increased pressure. That is, there may be such a situation that the required pressure is any pressure between the common rail pressure and the reference increased pressure.

In view of the above, in this embodiment, the fuel injection pressure is adjusted so that the fuel injection pressure conforms to the required pressure. In this case, FIG. 2 shows a time chart illustrating the transition of various values when the fuel is injected from the fuel injection valve 10. The command signal is the signal which is inputted into the solenoid actuator 109A of the fuel injection valve 10 from ECU 20 in order to inject the fuel. The command signal is the signal which is provided in order to operate the solenoid actuator 109A. The needle lift amount indicates the lift amount of the needle 113 (which may be the distance between the needle 113 and the injection hole 116 in the central axis direction of the fuel injection valve 10). The injection rate is the amount of the fuel injected per unit time from the fuel injection valve 10. The fuel injection pressure is the pressure of the fuel in the fuel pool 106, which is the pressure of the fuel injected from the fuel injection valve 10.

The response delay (valve opening delay) arises after the input of the command signal until the start of the increase in the needle lift amount. Similarly, the response delay (valve closing delay) also arises after the stop of the input of the command signal until the start of the decrease in the needle lift amount. Therefore, the injection rate is raised after the elapse of the time corresponding to the response delay after the input of the command signal. However, even in the case of the period which is provided until the start of the increase in the needle lift amount after the input of the command signal, i.e., the period in which the needle lift amount is zero and the fuel is not injected, the fuel injection pressure is lowered.

If the command signal is inputted, then the solenoid actuator 109A is operated, and the pressure in the control chamber 103 is released to the drain piping 119A via the orifice 119. In order to move the needle 113 in the direction to open the valve in accordance with the difference between the pressure of the fuel contained in the fuel pool 106 and the pressure of the fuel contained in the control chamber 103, the force provided by the pressure difference, which is directed in the direction to raise the needle 113, should be larger than the force which is directed in the direction to lower the needle 113 by means of the spring 112A. The pressure in the control chamber 103 is lowered but the fuel is not injected from the fuel injection valve 10 until the pressure difference sufficient to raise the needle 113 (hereinafter referred to as "predetermined pressure difference" as well) arises between the fuel pool 106 and the control chamber 103. The time, which is required until the predetermined pressure difference arises, corresponds to the response delay described above. In this case, the fuel pool 106 is communicated with the control chamber 103 via the orifice 118. Therefore, if the pressure in the control chamber 103 is lowered even during the response delay period, the pressure in the fuel pool 106 is also lowered while being delayed thereto. Therefore, even if the fuel is not actually injected, the fuel pressure in the fuel pool 106 is lowered. In this embodiment, the fuel injection pressure is lowered by utilizing the pressure drop of the fuel during the response delay period described above before the pressure intensification of the fuel injection pressure to be performed by the pressure intensifying unit 110. Note that even when the pressure reduction of the fuel according to this embodiment is not carried out, the pressure in the fuel pool 106 is lowered in accordance with the decrease in the pressure in the control chamber 103 during the fuel injection. Therefore, the fuel is actually injected from the injection hole 116 after the pressure in the fuel pool 106 is once lowered. On this account, the period in which the pressure in the control chamber 103 is lowered (i.e., the period in which the command signal is inputted) is determined in consideration of the decrease in the pressure in the fuel pool 106 even when the pressure reduction according to this embodiment is not carried out.

The pressure intensifying unit 110 increases the fuel injection pressure at the predetermined pressure intensification ratio. On this account, when the fuel injection pressure is lowered by utilizing the pressure drop of the fuel during the response delay period, the fuel injection pressure after the pressure intensification has the value obtained by multiplying, by the pressure intensification ratio, the fuel injection pressure after being subjected to the pressure reduction during the response delay period. Therefore, when the pressure reduction of the fuel is carried out, the fuel injection pressure after the pressure intensification is lowered as compared with when the pressure reduction of the fuel is not carried out. The fuel injection pressure after the pressure reduction can be adjusted in a wide range by adjusting the number of times of the execution of the pressure reduction of the fuel and/or the length of the period of the execution. Therefore, the fuel injection pressure after the pressure intensification can be also adjusted in a wide range. For example, the following procedure may be used. That is, the lower the required pressure is, the larger the number of times of the execution of the pressure reduction of the fuel is, or the longer the period of the execution of the pressure reduction of the fuel is.

FIG. 3 shows a time chart illustrating the transition of the command signal, the injection rate, and the fuel injection pressure when the pressure reduction is carried out before the pressure intensification of the fuel. In relation to the injection rate and the fuel injection pressure, solid lines indicate the case in which the pressure reduction is carried out before the pressure intensification of the fuel, and alternate long and short dash lines indicate the case in which the pressure reduction is not carried out before the pressure intensification of the fuel. PA is the value obtained by multiplying the common rail pressure by the pressure intensification ratio (i.e., the reference increased pressure), PB is the required pressure, PC is the common rail pressure (i.e., the reference pressure), and PD is the pressure after the pressure reduction. The value of PA is the largest. The values are decreased in an order of PB, PC, and PD. Both of the value (PA/PC) obtained by dividing the reference increased pressure PA by the common rail pressure PC and the value (PB/PD) obtained by dividing the required pressure PB by the pressure PD after the pressure reduction are the pressure intensification ratio described above. Note that when the required pressure PE is higher than the reference increased pressure PA or when the required pressure PB is lower than the common rail pressure PC, then it is necessary to adjust the common rail pressure PC. Therefore, this case is not dealt with in this application. The first time command signal is the command signal provided to decrease the fuel injection pressure. The second time command signal is the command signal provided to inject the fuel. Therefore, when the pressure reduction is not carried out before the pressure intensification of the fuel, only the second time command signal shown in FIG. 3 is inputted. When the pressure reduction is carried out before the pressure intensification of the fuel, the first time command signal is inputted within a range in which the injection rate is zero. Accordingly, the fuel injection pressure is once lowered as compared with the common rail pressure. The lower the required pressure PB is, the larger the pressure reduction amount is. Then, the larger the pressure reduction amount is the more increased the number of times of the input of the command signal within the range in which the fuel is not injected is, or the longer the time of the input of the command signal within the range in which the fuel is not injected (i.e., the length of the command signal) is. After that, the pressure intensification of the fuel is started. When the fuel injection pressure is raised, the command signal for the fuel injection is inputted. Note that the pressure drop may be also actually caused when the command signal for the fuel injection is inputted as described above. However, in FIG. 3, this pressure drop is omitted.

In this context, the pressure reduction amount (which may be regarded as the pressure drop amount), which is provided when the fuel injection pressure is lowered within the range in which the fuel is not injected, can be represented by the following expression.

$$dP=k(dV/V)$$

In the expression, dP represents the pressure reduction amount, k represents the modulus of elasticity of volume, dV represents the fuel amount flowing through the drain piping 119A, and V represents the volume of the range in which the influence of the pressure reduction of the fuel is exerted (hereinafter referred to as "pressure reduction volume" as well). The pressure reduction volume is the volume of the interior of the fuel injection valve 10, which is the total value of the volume of the range in which the fuel injection pressure after the pressure intensification is exerted (hereinafter referred to as "high pressure volume" as well), the volume of the common rail 3, and the volumes of the respective pipings (first fuel piping 11A, second fuel piping 11B, third fuel piping 11C, and piping ranging from high pressure fuel pump 5 to common rail 3) which are connected to the common rail 3 and which have the same pressure as the common rail pressure, other than the high pressure volume. The high pressure volume resides in the volumes of the pressure intensifying chamber 114C, the pressure intensification passage 108, the first fuel piping 11A disposed on the side of the injection passage 107 from the check valve 117, the injection passage 107, the fuel pool 106, and the control chamber 103.

FIG. 4 shows the relationship among the amount of the fuel flowing through the drain piping 119A (horizontal axis), the pressure reduction amount (vertical axis), and the pressure reduction volume. The fuel amount flowing through the drain piping 119A can be adjusted by the number of times of the flowing of the fuel through the drain piping 119A and the time for allowing the fuel to flow. In FIG. 4, the points indicated by circles and squares represent the pressure reduction amounts provided in respective times when the number of times of the flowing of the fuel through the drain piping 119A (number of times of the lifting of the injection control value 109) is increased in the state in which the fuel is not injected from the fuel injection valve 10. In this way, the larger the fuel amount flowing through the drain piping 119A is, the larger the pressure reduction amount is. Further, the smaller the pressure reduction volume is, the larger the pressure reduction amount provided when the same amount of the fuel is allowed to flow through the drain piping 119A is. In this case, when the fuel injection pressure is lowered, it is necessary to terminate the input of the command signal before the needle 113 is moved. On this account, the pressure reduction amount, which is brought about by the command signal provided one time, is limited. However, if the fuel pressure in the control chamber 103 is equal to the fuel pressure in the fuel pool 106 thereafter, it is possible to input the command signal again. Then, the fuel injection pressure can be further lowered by inputting the command signal again. That is, the pressure reduction amount can be further increased without injecting the fuel by inputting the command signal a plurality of times within the range in which the fuel is not injected from the fuel injection valve 10. Further, the fuel injection pressure can be adjusted to any arbitrary pressure ranging from the common rail pressure to the reference increased pressure by adjusting the number of times of the input of the command signal and the length of the input period of the command signal. Further, even if the number of times of the input of the command signal is identical, the fuel injection pressure can be also adjusted by adjusting the length of the input period of the command signal provided in each time. Even if the number of time of the input of the command signal is one, the fuel injection pressure can be also adjusted by adjusting the length of the input period of the command signal. That is, the fuel injection pressure can be adjusted by adjusting at least one of the number of times of the input of the command signal and the length of the input period of the command signal.

Note that when the fuel injection, which includes, for example, the pilot injection, the main injection, and the after-injection, is carried out a plurality of times during one cycle, the fuel injection pressure can be changed every time when each of the injections is performed. However, when the fuel injection, which includes, for example, the pilot injection, the main injection, and the after-injection, is carried out a plurality of times, if all of the injections are carried out at an identical pressure, then it is enough that the common rail pressure is increased without performing the pressure intensification by using the pressure intensifying unit 110. Therefore, in this embodiment, when the fuel injection, which includes, for example, the pilot injection, the main injection, and the after-injection, is carried out a plurality of times, the pressure intensification of the fuel is carried out by using the pressure intensifying unit 110, only when it is necessary to perform the pressure intensification in any one of the injections.

FIG. 5 shows a flow chart illustrating a flow for adjusting the fuel injection pressure according to this embodiment. This flow chart is carried out by ECU 20 every time when the fuel injection is performed. When the fuel injection, which includes, for example, the pilot injection, the main injection, and the after-injection, is carried out a plurality of times during one cycle, this flow chart is carried out every time when each of the injections is performed. Note that this flow chart is provided to control the fuel injection pressure. The control for injecting the fuel is distinctly carried out by ECU 20. In this embodiment, ECU 20, which executes the flow chart shown in FIG. 5, corresponds to the controller according to the present invention.

In Step S101, the operation state of the internal combustion engine 1 is detected. In this step, the engine rotation speed and the fuel injection amount are detected. The fuel injection amount is correlated with the accelerator opening degree. Therefore, it is also allowable that the accelerator opening degree is detected in place of the fuel injection amount. Note that the fuel injection amount, which is referred to herein, is the total amount of the fuel injected per one cycle in one cylinder in order to generate the torque in the internal combustion engine 1.

In Step S102, the required pressure is calculated. When the fuel injection, which includes, for example, the pilot injection, the main injection, and the after-injection, is carried out a plurality of times, the required pressure is provided in the injection which is the objective of this flow chart. The required pressure in each of the fuel injections relates to the engine rotation speed and the fuel injection amount. Therefore, the relationship between the required pressure and the engine rotation speed and the fuel injection amount is previously determined and mapped, for example, by means of any experiment, and the relationship is stored in ECU 20 beforehand.

In Step S103, it is judged whether or not the required pressure is higher than the reference pressure (common rail pressure in this embodiment) and lower than the reference increased pressure. In this step, it is judged whether or not it is necessary to perform the pressure reduction before the pressure intensification of the fuel. If the affirmative judgment is made in Step S103, the routine proceeds to Step S104. On the other hand, if the negative judgment is made, the routine proceeds to Step S107.

In Step S104, the pressure reduction amount of the fuel is calculated. The pressure reduction amount is calculated on the basis of the common rail pressure, the pressure intensification ratio, and the required pressure. That is, the required fuel injection pressure after the pressure reduction is calculated by dividing the required pressure by the pressure intensification ratio. Then, the pressure reduction amount of the fuel can be calculated by subtracting the required fuel injection pressure after the pressure reduction from the common rail pressure.

In Step S105, the length of the input period of the command signal and the number of times of the input of the command signal are calculated. The relationship among the length of the input period of the command signal, the number of times of the input of the command signal, and the pressure reduction amount of the fuel is previously determined, for example, by means of any experiment or simulation. If the pressure reduction amount is insufficient when the pressure reduction is performed once, the pressure reduction is performed a plurality of times. For example, the pressure reduction is carried out a plurality of times by using a constant pressure reduction amount, and the pressure reduction amount is adjusted when the last pressure reduction is performed. Accordingly, the total amount of the pressure reduction amounts is adjusted to the required pressure reduction amount. Alternatively, it is also allowable that the pressure reduction amount per one time is set so that the pressure reduction amounts provided in respective times are equal to one another. Then, in Step S105, the pressure reduction of the fuel is carried out. In Step S106 of this procedure, the command signal is inputted in accordance with the length of the input period of the command signal and the number of times of the input of the command signal calculated in Step S105. Note that, a sensor for detecting the fuel injection pressure may be provided for the fuel injection valve 10 beforehand, and the fuel injection pressure may be subjected to the feedback control during the pressure reduction of the fuel.

On the other hand, in Step S107, it is judged whether or not the required pressure is equal to the reference increased pressure. In this step, it is judged whether or not the pressure intensification of the fuel is necessary. That is, if the negative judgment is made in Step S103, it is considered that the required pressure is equal to any one of the reference increased pressure and the common rail pressure. If the required pressure is the reference increased pressure, it is necessary to perform the pressure intensification of the fuel. If the affirmative judgment is made in Step S107, the routine proceeds to Step S108. On the other hand, if the negative judgment is made, this flow chart is terminated. Then, in Step S108, the pressure intensification of the fuel is carried out. In this case, the fuel injection pressure is increased by using the preset pressure intensification ratio.

As explained above, according to this embodiment, it is possible to adjust the fuel injection pressure after the pressure intensification by adjusting the pressure reduction amount before performing the pressure intensification for the fuel at the predetermined pressure intensification ratio. Therefore, even if the required pressure is higher than the common rail pressure and lower than the reference increased pressure, it is possible to adjust the actual fuel injection pressure to the required pressure. Then, when the fuel is actually injected, the pressure intensification of the fuel by the pressure intensifying unit 110 is completed. Therefore, it is possible to suppress the fluctuation of the fuel injection pressure during the fuel injection. In this way, it is possible to maintain the fuel injection pressure at the proper value. Therefore, it is possible to suppress the combustion noise, and/or it is possible to reduce the amount of production of the smoke.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

DESCRIPTION OF THE REFERENCE SIGNS

1: internal combustion engine, 3: common rail, 5: high pressure fuel pump, 10: fuel injection valve, 11A: first fuel piping, 11B: second fuel piping, 11C: third fuel piping, 20: ECU, 27: fuel pressure sensor, 103: control chamber, 104: pressure intensifying piston, 104A: large diameter piston portion, 104B: small diameter piston portion, 105: nozzle, 107: injection passage, 108: pressure intensification passage, 109: injection control valve, 109A: solenoid actuator, 110: pressure intensifying unit, 111: pressure intensification control valve, 111A drain piping, 112: command piston, 112A: spring, 113: needle, 114A, pressure chamber, 114B: pressure intensification control chamber, 114C: pressure intensifying chamber, 115: spring, 116: injection hole, 117: check valve, 118: orifice, 119: orifice, 119A: drain piping.

The invention claimed is:

1. A fuel injection apparatus for an internal combustion engine, comprising:

a fuel injection valve configured to inject fuel by opening an injection hole in accordance with movement of a needle;

a fuel rail configured to supply the fuel at a reference pressure to the fuel injection valve;

a fuel passage which is communicated with the injection hole from the fuel rail;

an opening/closing device which includes a control chamber connected to the fuel passage and a pressure reducing device for lowering a pressure of the fuel contained in the control chamber as compared with a pressure of the fuel contained in the fuel passage and configured to move the needle in a direction to open the injection hole if a pressure difference between the pressure of the fuel contained in the fuel passage and the pressure of the fuel contained in the control chamber is not less than a predetermined pressure difference;

a pressure intensifying chamber which is connected to the fuel passage and configured to increase the pressure of the fuel contained in the fuel passage at a constant pressure intensification ratio; and a controller comprising at least one processor configured to increase the pressure of the fuel contained in the fuel passage by means of the pressure intensifying chamber after operating the pressure reducing device so that the pressure difference after the operation has a value smaller than the predetermined pressure difference, if the pressure of the fuel contained in the fuel passage, which is required upon fuel injection from the fuel injection valve, is higher than the reference pressure and lower than a reference increased pressure as a value obtained by multiplying the reference pressure by the pressure intensification ratio, wherein the controller is configured to operate the pressure reducing device a plurality of times for one fuel injection.

2. The fuel injection apparatus for the internal combustion engine according to claim 1, wherein the controller changes a number of times of the operation of the pressure reducing device depending on the pressure of the fuel contained in the fuel passage required during the fuel injection, when the pressure reducing device is operated so that the pressure difference after the operation has a value smaller than the predetermined pressure difference.

3. The fuel injection apparatus for the internal combustion engine according to claim 1, wherein the controller changes a period in which the pressure reducing device is operated, depending on the pressure of the fuel contained in the fuel passage required during the fuel injection, when the pressure reducing device is operated so that the pressure difference after the operation has a value smaller than the predetermined pressure difference.

4. The fuel injection apparatus for the internal combustion engine according to claim 2, wherein the controller changes a period in which the pressure reducing device is operated, depending on the pressure of the fuel contained in the fuel passage required during the fuel injection, when the pressure reducing device is operated so that the pressure difference after the operation has a value smaller than the predetermined pressure difference.

* * * * *